United States Patent [19]

Digby

[11] Patent Number: 4,524,629

[45] Date of Patent: Jun. 25, 1985

[54] COMPACT ENGINE STARTER DRIVE

[75] Inventor: James J. Digby, Elmira, N.Y.

[73] Assignee: Facet Enterprises, Inc., Tulsa, Okla.

[21] Appl. No.: 409,196

[22] Filed: Aug. 18, 1982

[51] Int. Cl.[3] ..... F02N 15/06

[52] U.S. Cl. ..... 74/7 R

[58] Field of Search ..... 74/6, 7 R, 7 A

[56] References Cited

U.S. PATENT DOCUMENTS

| | | | |
|---|---|---|---|
| 2,440,657 | 4/1948 | Miller | 74/7 R |
| 2,747,414 | 5/1956 | Cromwell et al. | 74/7 R |
| 2,901,912 | 9/1959 | Digby | 74/7 R |
| 2,902,864 | 9/1959 | Digby | 74/7 R |
| 2,922,307 | 1/1960 | Buxton | 74/7 R |
| 2,933,926 | 4/1960 | Buxton et al. | 74/7 R |
| 2,979,961 | 4/1961 | Spencer | 74/7 R |
| 2,984,115 | 5/1961 | Digby | 74/7 R |
| 2,996,924 | 8/1961 | Sabatini | 74/7 R |
| 3,222,938 | 12/1965 | Digby | 74/7 R |

*Primary Examiner*—Allan D. Herrmann
*Attorney, Agent, or Firm*—Remy J. VanOphem

[57] ABSTRACT

An engine starter drive adapted to engage an engine ring gear is disclosed. The drive has a clutch connection to connect the driving sleeve member to the outer sleeve member. The outer sleeve member further has an external helical spline with a notch. A control nut is threadably mounted on the helical splines of the outer sleeve member and has a spring loaded detent which engages the notch. The control nut is connected to the pinion gear by means of a barrel member. Rotating the power shaft causes the control nut to move along the helical splines to traverse the pinion gear into mesh with the engine ring gear and crank the engine. Further rotation of the power shaft causes the control nut to move axially to compress an annular resilient member which is interposed the barrel member and the control nut. Further compression of the resilient member causes torque to be transmitted from the power shaft to the pinion gear to rotate the ring gear. When the engine fires, the acceleration of the pinion causes the control nut to move back on the screw shaft until the detent engages a shoulder of the notch. After the engine starts and the pinion rotates to a predetermined speed, the detent withdraws from the notch in the outer sleeve member and the control nut withdraws the pinion gear from engaging the engine ring gear. The detent then engages a shoulder on the outer sleeve to prevent undesired meshing of the pinion to the ring gear. An indexing mechanism also is provided to rotate the pinion gear to clear any abutment with the engine ring gear to prevent the pinion gear to mesh with it.

12 Claims, 4 Drawing Figures

Fig-3
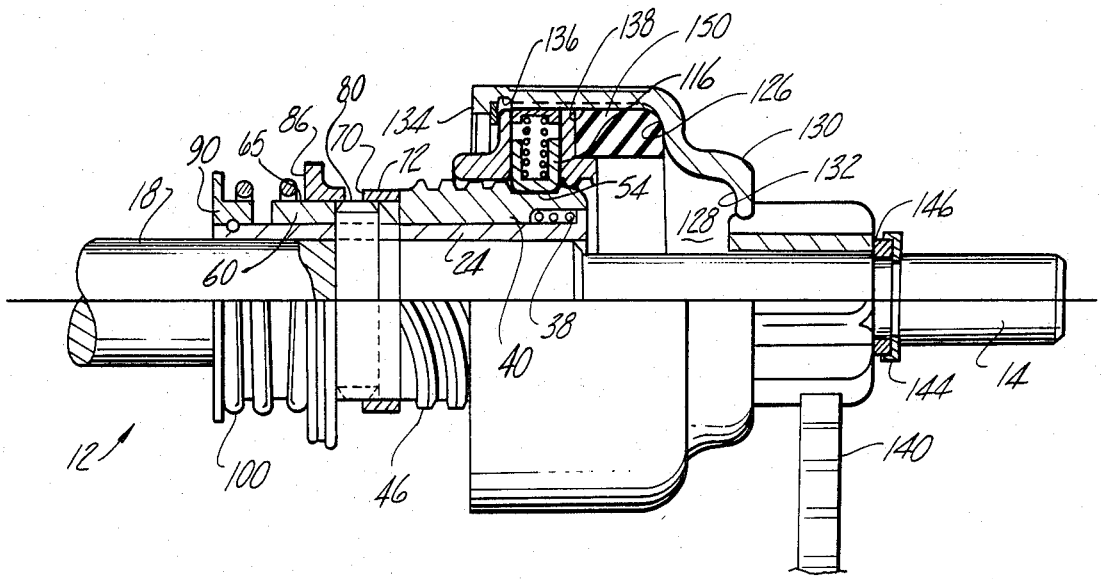
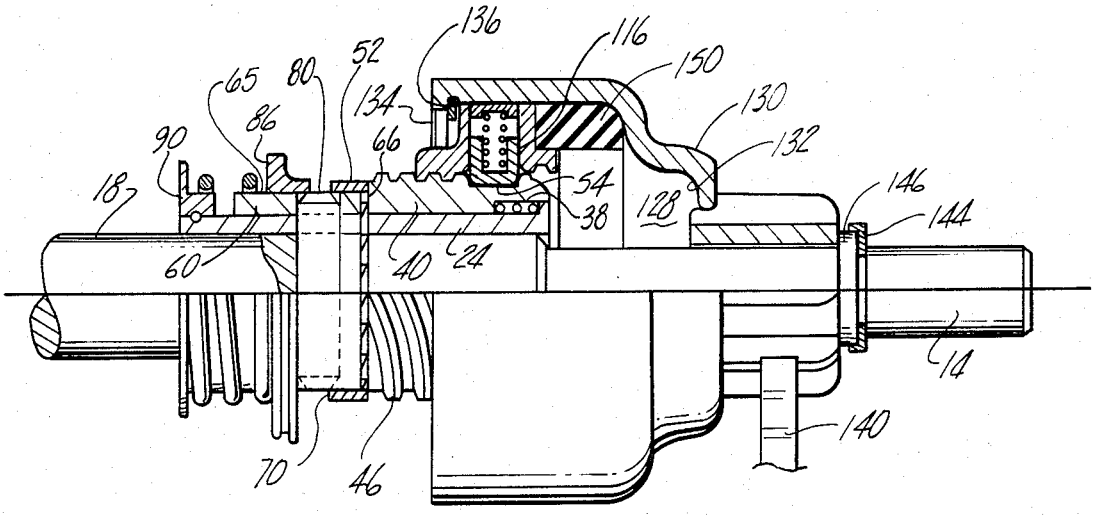
Fig-4

COMPACT ENGINE STARTER DRIVE

FIELD OF THE INVENTION

The present invention relates to engine starter gearing devices and more particularly to a starter drive of the type in which a drive pinion is caused to engage and drive an engine gear responsive to the acceleration of the starting motor shaft and to disengage therefrom in response to the acceleration of the engine gear when the engine becomes self-operating.

BACKGROUND OF THE INVENTION

As is well known in the prior art, an engine starter normally includes a starter motor having an armature and an output shaft with a drive pinion slidably mounted on the output shaft which is caused to engage and drive an engine gear. In recent years, however, in response to the national fuel economy standards, the automobile manufacturers have been downsizing their products. This has created an additional requirement that starter motors be as compact as possible in order to permit the greatest utilization of underhood space in these vehicles. This is particularly important in front wheel drive applications where not only the engine but the transmission and the transaxle are located at the front of the vehicle. Thus, a more compact engine starter drive is highly desirable for any new automotive application. In addition, in response to foreign competition, the automotive manufacturers are requiring lower costs, better reliability, and more serviceable construction.

In prior art starters, such as U.S. Pat. No. 2,979,961 to Glenn S. Spencer, when the pinion is fully or partially in mesh with the ring gear of the engine, a detent will radially engage a notch or recess formed in the screw shaft, thus insuring continuing pinion mesh until the engine is reliably started; yet allowing sufficient axial movement of the screw shaft to enable the one way clutch teeth to overrun. During initial application of torque to the engine ring gear, the screw jack action between a control nut and screw shaft will axially force the clutch members in a demeshing direction. This screw jack action must be absorbed by an elastically deformable compression ring element which is compressively confined between a thrust plate mounted near the clutch and a second thrust plate mounted on the power shaft. This configuration, however, leads to a very long gearing device which is not suitable for present day automotive applications.

Buxton, U.S. Pat. No. 2,933,926, issued Apr. 26, 1960, to the assignee of the present application poses a similar engine starter drive wherein a resilient member is replaced with a series of coupling members which are designed to flip if a predetermined maximum torque is exceeded at the initiation of the cranking operation. This again leads to a very long starter drive configuration.

Another similar engine starter device is disclosed in U.S. Pat. No. 2,901,912, also owned by the assignee of the present invention. This device, which is similar to the device described in U.S. Pat. No. 2,933,926 also incorporates a frictional coupling, the torque capacity of which is directly and positively controlled by means which are a function of the load transmitted to it. This device also provides a very long starter gearing device envelope.

Another prior art device which is similar to the aforementioned starter devices is U.S. Pat. No. 2,922,307, issued to Buxton on Jan. 26, 1960, wherein a rubber block is incorporated into the starter drive as a yielding transmission element. Thus, the pinion is meshed with the engine gear. Further rotation of the power shaft causes the control nut to compress the elastic block and apply torque to the elastic block to yieldably rotate the pinion. The compression of the elastic member causes the chambers formed in the block to be flattened out with the consequent establishment of the sealing attachment to the closed end of the retainer cap and the control nut on the opposite end. This drive also provides a very long envelope which is undesirable for present day automotive applications.

Other prior art starter drives of this type are disclosed in U.S. Pat. No. 2,902,864 to Digby; and U.S. Pat. No. 2,996,924, issued to Sabatani; both owned by the assignee of the present application.

Perhaps the most popular starter drive used to date is disclosed in U.S. Pat. No. 3,222,938, issued to Digby on Dec. 14, 1965. This patent is also owned by the assignee of the present application. Digby discloses a engine starter drive having a power shaft with a shoulder formed thereon and defining a pilot hole adjacent the shoulder. A driving sleeve is fixedly mounted to the power shaft. A locating pin is mounted in the sleeve and engages the pilot hole to maintain the sleeve in engagement with the shoulder. The locating pin further has a flattened stem protruding radially from the drive sleeve and provides a shoulder substantially flush with the exterior surface of the driving sleeve. A hollow screw shaft is slidably journalled on the driving sleeve and a driving clutch ring is splined on the driving sleeve with an overrunning connection with the screw shaft. The driving clutch ring and the screw shaft are normally positioned and will engage each other. In addition, a spring is supplied to urge the screw shaft toward its normal position. A mesh enforcing mechanism is included resisting the movement of the driving clutch member away from its normal position. The mechanism includes an enclosing cap member having a bottom flange slidably mounted on the driving sleeve. The bottom flange of the cup member is normally seated against the flat surface of the locating pin and engages the shoulder to retain the locating pin in an operative position. A spring is also provided for resisting the further axial movement of the driving clutch member after a predetermined compression of the forcing mechanism. A control nut is threaded on the screw shaft and a pinion is slidably journalled on the power shaft for movement into and out of mesh with a ring gear of the engine to be started. Finally, a barrel member is rigidly connected to the control nut and the pinion gear.

The starter motor is activated, to cause acceleration of the drive shaft which, in turn, causes the control nut to thread itself onto the screw shaft, overcoming the initial retardation of the detent and moving the barrel assembly forwardly until the pinion enters into mesh with the engine gear. Further movement of the pinion gear is stopped by the abutment on the drive shaft. Clear rotation of the drive shaft and the screw shaft causes the screw shaft to be traversed from the abutment by the screw jack action which compresses the mesh enforcing spring and thereafter the cushioning ring until sufficient torque has been built up to initiate rotation of the engine gear. This rearward movement of the screw shaft is permitted by a counterbore and its rearward end which accommodates a snap ring. The engine gear is accelerated, and the speed of rotation of the pinion is correspondingly increased, by which the barrel and control nut may become accelerated more rapidly than the motor shaft. However, the detent latch in the control nut prevents the control nut from being threaded back to its idle position on the screw shaft. Thus, the pinion is maintained in mesh with the engine gear. When the engine becomes self-operative, subsequent rotation of the pinion and barrel assembly becomes high enough to cause the detent latch to move outwardly by centrifugal force thereby disnegaging itself from the abutment on the screw shaft. The screw shaft is, thus, permitted to be decelerated to the speed of the motor shaft by virtue of its friction connection with the driving clutch and driving sleeve which is made effective by the clutch spring. The control nut and its associated barrel and pinion consequently traverse back to an idle position where they are maintained by the engagement of the detent latch with a frusto-conical surface on the screw shaft. This device, however, is very long since the resilient member is encased in a separate housing.

None of the above aforementioned prior art starter drives, therefore, provide a compact and simple starter drive for present automotive applications.

SUMMARY OF THE PRESENT INVENTION

The present invention is directed to a starter drive which is compact and interchangeable with both a folo-thru type drive and roll clutch starter drive.

The present invention provides a starter gearing device for starting an internal combustion engine. The starter includes a power shaft with a pinion gear slidably mounted on the power shaft for axial movement relative to the power shaft. The pinion gear further moves into and out of engagement with the ring gear of the engine to be started. An outer sleeve member is mounted on the power shaft. The outer sleeve member has an external helical spline formed thereon. A mechanism is interposed the outer sleeve member and the power shaft for transmitting torque between the power shaft and outer sleeve member in one direction of relative rotation. In addition, a mechanism is interposed the pinion gear and the outer sleeve member for traversing the pinion gear into motion with the ring gear of the engine to be started and for disengaging the pinion gear from the ring gear of the engine to be started when the pinion gear rotates above a predetermined speed. Additionally, a mechanism is interposed the pinion gear and the outer sleeve member for cushioning the movement of the pinion gear in a direction away from the ring gear of the engine to be started when the pinion gear rotates below a predetermined speed.

It is, therefore, a primary object of the present invention to provide a compact, efficient, and reliable starter device in operation and simple and economic in construction.

It is another object of the present invention to provide an engine starter device which is compact and which may be slipped on the armature shaft of the starting motor so as to be fully operative for its intended service and yet is simple in construction.

It is still another object of the invention to provide a starter device having a capacity to absorb shock loading transmitted from the pinion gear to the control nut and which is compact and economical in construction.

These and other objects and teachings of the invention will become apparent in the following detailed description taken from the drawings and claims which form a part of the specification.

BRIEF DESCRIPTION OF THE DRAWINGS

FIG. 3 is a detailed sectional view of the engine starter device with the pinion gear engaging the ring gear to transmit torque; and FIG. 4 is a detailed sectional view of the engine starter device showing the clutch teeth of the driving member and the outer sleeve member separated when the starter gear engages the ring gear and the engine overruns the starter.

DETAILED DESCRIPTION OF THE PREFERRED EMBODIMENT

Figure 1:
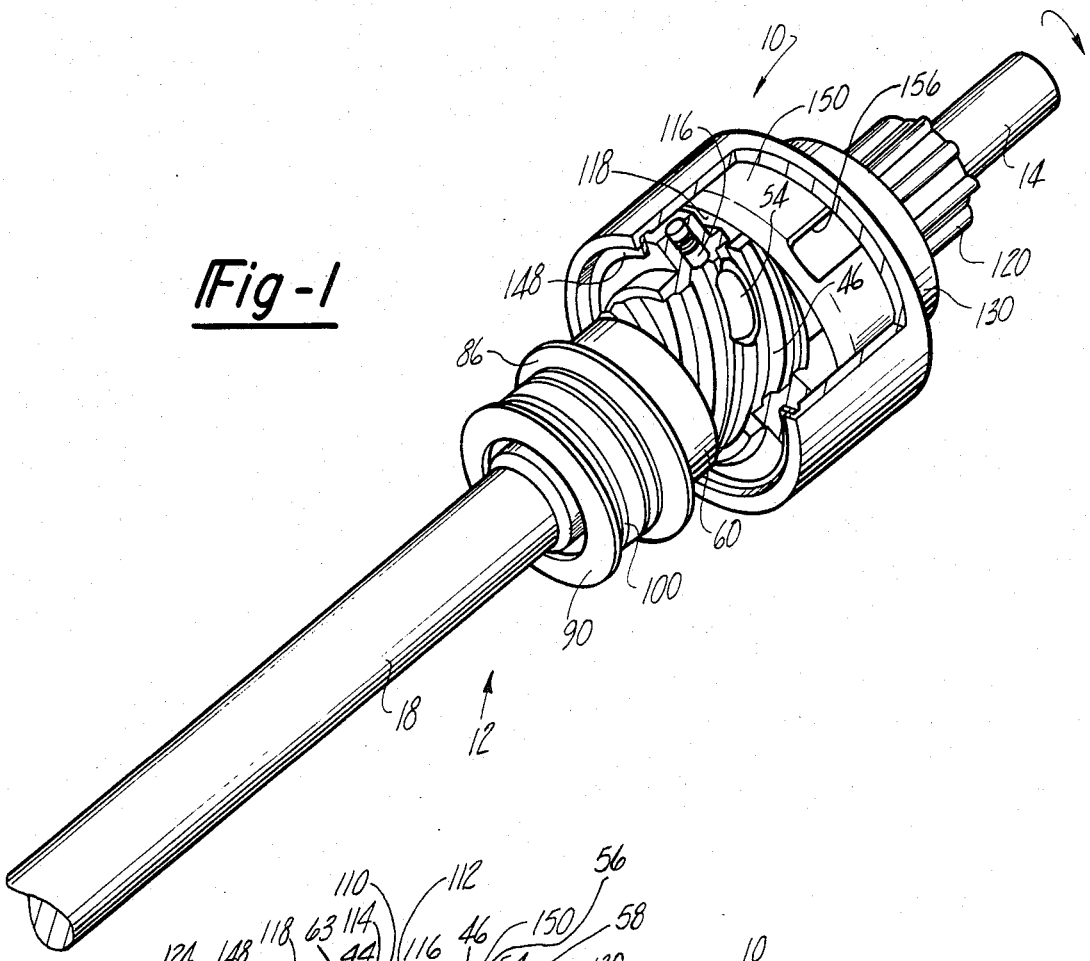
FIG. 1 is a perspective view of an engine starter device according to the principles of the present invention.

In the figures, a starter device according to the present invention is generally designated by the numeral 10. The starter device 10 is mounted on a power shaft 12 of a starter motor (not illustrated) which has one end 14. The shaft 12 further has a first outer diameter 16 and a second outer diameter 18. The second outer diameter 18 is larger than the first outer diameter 16. A radial shoulder portion 20 is formed between the first outer diameter 16 and the second outer diameter 18. A diametral hole 22 is formed in the second outer diameter 18 of the power shaft 12.

An intermediate sleeve member 24 is mounted on the second outer diameter 18 of the power shaft 12. The intermediate sleeve member 24 has one end 26 and an opposite end 28. The one end 26 has a radial portion 30 or shoulder portion which extends above the periphery of the intermediate sleeve member 24. A pair of apertures 32 are formed through the intermediate sleeve member 24 between the one end 26 and the opposite end 28 for a purpose to be described later on herein.

An outer sleeve member 40 is slidably mounted on the intermediate sleeve member 24. The outer sleeve member 40 has a first end 42 mounted adjacent the one end 26 of the intermediate sleeve member and a second end 44 opposite the first end 42. External helical splines 46 are formed on the outer diameter of the outer sleeve member 40. A counterbore 48 is formed adjacent the one end 42 on the inner diameter 50 of the outer sleeve member 40. The radial portion 30 of the intermediate sleeve member 24 extends into the counterbore 48. A biasing member 38 is disposed in the counterbore 48 so as to urge the radial portion 30 away from a shoulder 49 of the counterbore 48. A one way clutch tool 52 is formed on the second end 44 of the outer sleeve member 40. A notch 54 is formed in one of the external helical splines 46 adjacent the one end 42. The notch 54 is preferably milled and has a radial shoulder portion 56 and an opposite sloped shoulder portion 58 which is adjacent to the one end 42 for a purpose to be described later on herein.

A driving sleeve member 60 is also slidably mounted on the periphery of the intermediate sleeve member 24 so as to be adjacent the outer sleeve member 40. The driving sleeve member 60 has one end 62 and an opposite end 64. The one end 62 has one way clutch teeth 66 which mutually engage the clutch teeth 52 on the outer sleeve member 40.

An annular spacer member 70 is slidably mounted in a diametral groove 41 formed near the periphery of and adjacent to the second end 44 of the outer sleeve member 40. In addition, the annular spacer member 70 is slidably mounted in a diametral groove 61 formed adjacent to the periphery of the driving sleeve member 60 and adjacent to the one end 62. Thus, the spacer member 70 is disposed above the clutch teeth 52 and 66. The annular spacer member 70 further has an outer diameter 72.

The driving sleeve member 60 has a pair of slotted apertures 68 to permit the axial movement of the driving sleeve member relative to the intermediate sleeve member 24 and a retainer pin 80. The retainer pin 80 is mounted through the slotted apertures 68 of the driving sleeve member 60, through the pair of apertures 32 in the intermediate sleeve member 24 and the diametral hole 22 in the power shaft 12 to non-rotatably connect the driving sleeve member 60 and the intermediate sleeve member 24 to the power shaft 12.

The driving sleeve member 60 also has a first outer diameter 63. In addition, the driving sleeve member 60 also has a second outer diameter 65 adjacent to the first outer diameter 63. The second outer diameter 65 is smaller than the first outer diameter 63 and forms a radial shoulder portion 69 therebetween. A retainer member 82 is slidably mounted on the second outer diameter 65 of the driving sleeve member 60. The retainer member 82 has an axially extending portion 84 and a radially extending portion 86. The axially extending portion 84 of the retainer member 82 is mounted adjacent to the radial shoulder portion 69 of the driving sleeve member 60.

A stop member 90 is slidably mounted on the outer diameter of the intermediate sleeve member 24 adjacent to the opposite end 28. A diametral groove 27 is formed adjacent to the opposite end 28. A lock ring member 92 is disposed in the diametral groove 27 to prevent axial movement of the stop member 90 with respect to the intermediate sleeve member 24. The stop member 90 further has a counterbore 94 into which is disposed the lock ring member 92. The stop member 90 also has a radially extending portion 96.

A helical biasing member 100 is mounted between the retainer member 82 and the stop member 90. Thus, the one end of the helical biasing member 100 abuts against the radially extending portion 86 and the other end of the helical biasing member abuts against the radially extending portion 96 of the stop member 90 to urge the one way clutch teeth 66 on the driving sleeve member 60 into mesh with the one way clutch teeth 52 of the outer sleeve member 40. On the other hand, as previously described, a biasing member 38 urges the outer sleeve member 40 away from the radially extending portion 30 of the intermediate sleeve member 24.

A control nut 110 slidably engages the external helical splines 46 formed on the outer sleeve member 40. The control nut 110 further has a plurality of radial lugs 112. One of the radial lugs is formed with a radial aperture 114 to receive a spring pressed detent 116 therein. The detent 116 is mounted for radial sliding movement in the control nut 110 and for bearing on the periphery of the outer sleeve member 40. As previously discussed, the outer sleeve member 40 has a notch 54 which is positioned to receive the detent 116 when the control nut 110 threadably advances along the external helical splines 46 of the outer sleeve member 40. The outer sleeve member 40 also has an inclined shoulder 43 adjacent the one end 44 and adjacent the diametral groove 41. The inclined shoulder 43 and the outer diameter 72 of the annular spacer member 70 are positioned to receive the detent 116 to provide an antidrift means in order to prevent the control nut 110 from drifting away from the idle position shown in FIG. 2.

A pinion gear 120 is slidably mounted on the first outer diameter 16 of the power shaft 12 adjacent to the one end 14 for movement into and out of mesh with the ring gear 140 of engine to be started. A bearing member 122 is preferably interposed between the first outer diameter 16 of the power shaft 12 and the inner diameter of the pinion gear 120.

A barrel or enclosing cup member 130 connects the pinion gear to the control nut 110. The barrel member 130 has a closed end 132 which is suitably connected to the pinion gear 120 and an open end 134 which is opposite the closed end 132. The barrel member 130 further has a plurality of axially extending lugs 138 adjacent the open end 134 to engage the plurality of radial lugs 112 on the control nut 110. In between the closed end 132 and the open end 134 of the barrel member 130 is formed a cavity 128. This permits the barrel member 130 to encapsulate therein the outer sleeve member 40, the control nut 110 and an annular resilient cushion member 150 therein.

The annular resilient cushion member 150 is elastically deformable and has a plurality of slots 156 formed in its periphery to engage the axially extending lugs 138 in the barrel member 130. Thus, annular resilient cushion member 150 is rotatably mounted with the barrel member 130 and is interposed a radial shoulder 126 in the barrel member 130 and an annular groove 118 formed in the control nut 110 at its opposite end. Finally, the control nut 110 and the annular resilient cushion member 150 are prevented from moving out of the cavity 128 in the barrel member 130 by means of a lock ring 148 which is disposed in a circular groove 136. Thus, the lock ring 148 prevents axial movement of the control nut past the open end 134 of the barrel member 130.

Figure 2:
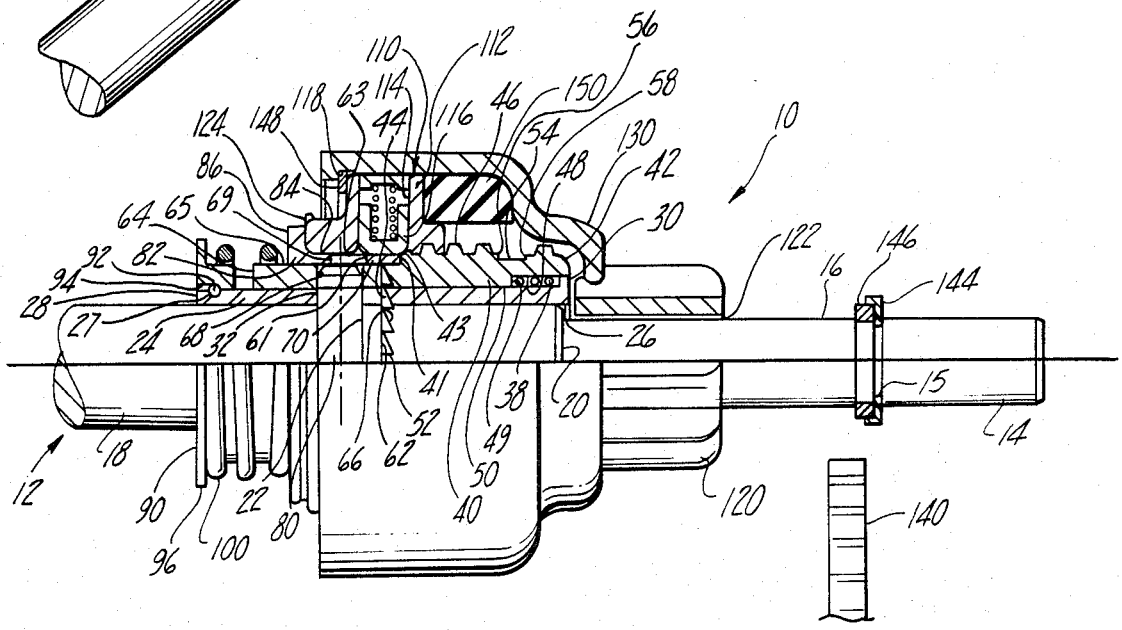
FIG. 2 is a detailed sectional view of the engine starter device with the power shaft at rest.

As shown in FIG. 2, the radially extending portion 86 of the retainer member 82 abuts against the shoulder 124 of the control nut 110 and the axially extending portion 84 is interposed the control nut 110 and the driving sleeve member 60.

Finally, the first outer diameter 16 of the power shaft 12 has an axial stop member 144 which is inserted into a circular groove 15 formed adjacent the one end 14 of the power shaft 12. The axial stop member 144 further has a shield member 146 which is mounted on the first outer diameter 16 of the power shaft 12 and extends axially onto the periphery of the axial stop member 144. The axial stop member 144 prevents the axial movement of the pinion gear 120 beyond a predetermined point and is located on the power shaft 12 in order to insure that the pinion gear 120 engages the ring gear 140 of the engine to be started.

OPERATION

With the assembly at rest as shown in FIG. 1, rotation of the power shaft 12 in the direction of the arrow is transmitted through the retainer pin 80 which causes the intermediate sleeve member 24 and the driving sleeve member 60 to rotate with the power shaft 12. The driving sleeve member 60 has one way clutch teeth 66 which are connected to the mutually engaging one way clutch teeth 52 on the outer sleeve member 40 so as to rotate the outer sleeve member 40 with the power shaft 12. The inertia of the pinion gear 120, the barrel member 130, and the control nut 110 causes the control nut to move along the helical splines 46 to traverse the pinion gear 120 into mesh with the ring gear 140. The pinion gear 120 is prevented from further axial movement by virtue of the axial stop member 144 on the power shaft 12. The control nut 110, however, continues to move axially towards the axial stop member 144 and in doing so compresses the annular resilient cushion member 150. This movement of the control nut 110 to compress the annular resilient cushion member 150 continues until the annular resilient cushion member transmits torque from the control nut to the barrel member 130 so as to rotate the pinion gear 120. The further rotation of the power shaft 12 causes cranking torque to be transmitted to the ring gear 140 in order to start the engine as shown in FIG. 3.

If during the traversing mode of the control nut 110 along the outer sleeve member 40 towards the ring gear 140 the pinion gear 120 does not engage the engine ring gear 140 but merely abuts the ring gear, an indexing means is provided to rectify this condition. The indexing means permits the control nut 110 to be rotated on the helical splines 46 with respect to the outer sleeve member 40. In this abutting condition, the control nut 110 moves rearward, that is, towards the retainer pin 80 which causes compression of the helical biasing member 100. The control nut 110 is thereby rotated by traveling along the external helical splines 46 to cause the pinion gear 120 to clear the abutment with the engine ring gear 140. This permits the pinion gear 120 to mesh with the engine ring gear to start the engine.

When the engine fires, the engine ring is accelerated causing acceleration of the pinion gear 120 thus forcing the control nut 110 in the direction of its originating position on the power shaft 12. The relationship of the detent 116 to the radial shoulder portion 56 of the notch 54 will avoid this movement. Any further movement of the control nut 110 towards the retainer pin 80 is absorbed by the compression of the annular resilient cushion member 150.

When a successful start is secured, the acceleration of the pinion gear 120 to a predetermined speed causes the detent 116 to withdraw due to its centrifugal force from the notch 54 in outer sleeve member 40. Thus, the control nut 110 and the barrel traverse the power shaft 12 towards the retainer pin 80 under the influence of the biasing member 38 and deceleration of the outer sleeve member 40 so that the assembly is returned to the idle position as shown in FIG. 2. The undesired remeshing of the pinion gear with the enging ring gear 140 is prevented by the engagement of the detent 116 with the inclined shoulder 43 on the outer sleeve member 40.

When the pinion gear 120 rotates at a speed faster than the power shaft 12, the helical spline relationship between the control nut and outer sleeve member 40 causes the outer sleeve member 40 to move rearward along the intermediate sleeve member 24 to compress the helical biasing member 100. This rearward motion permits the movement of the driving sleeve member 60 towards the stop member 90 and thus allows the teeth 52,66 to slip past or override each other.

Although but one embodiment of the invention has been shown and described in detail, it will be understood that changes may be made in the design and arrangement of the assembly without departing from the spirit and scope of the invention as defined by the appended claims.

What is claimed is:

1. An engine starter device for starting an internal combustion engine, said internal combustion engine having starter means and a ring gear, said starter means including a power shaft, said device comprising:

a pinion gear slidably mounted on said power shaft for axial movement relative to said power shaft, said pinion gear further moving into and out of engagement with said ring gear of said internal combustion engine;

an outer sleeve member mounted on said power shaft, said outer sleeve member having external helical splines;

means interposed said outer sleeve member and said power shaft, for transmitting torque between said power shaft and said outer sleeve member in one direction of relative rotation;

an intermediate sleeve member non-rotatably mounted on said power shaft, said intermediate sleeve member having a first portion for slidably and rotatably mounting said outer sleeve member and a second portion for slidably mounting said means for transmitting torque;

a control nut member threadably mounted on said external helical splines of said outer sleeve member;

an enclosing cup member interposed said control nut member and said pinion gear, said enclosing cup member having a closed end connected to said pinion gear for rotation therewith, and an open end opposite said closed end and defining a cavity between said open end and said closed end; and means for translating torque from said control nut member to said pinion gear, said means for translating torque being disposed in said cavity of said enclosing cup member between said control nut member and said pinion gear.

2. An engine starter device as claimed in claim 1 further comprising:

a stop member mounted adjacent to one end of said power shaft for limiting the axial movement of said pinion gear along said power shaft.

3. An engine starter device as claimed in claim 1 further comprising:

means for indexing said pinion gear when said pinion gear abuts said ring gear of said internal combustion engine such that said indexing means rotates said pinion gear to clear the abutment of said ring gear and engages said pinion gear with said ring gear of said internal combustion engine.

4. An engine starter device as claimed in claim 1 further comprising:

anti-drift means for preventing axial movement of said pinion gear towards said ring gear of said internal combustion engine after said internal combustion engine has started and said starter device has disengaged from said ring gear.

5. An engine starter device as claimed in claim 1 further comprising resilient means interposed said outer sleeve member and said intermediate sleeve member, for disengaging said pinion gear from said ring gear upon deceleration of said outer sleeve member.

6. An engine starter device as claimed in claim 1 wherein said outer sleeve member further comprises one end adjacent said pinion gear, said one end having a notch in said external helical splines of said outer sleeve member; wherein said control nut member further comprises a detent means for transmitting torque between said power shaft and said outer sleeve member in one direction of relative rotation; and wherein said means for translating torque further comprises an annular resilient member.

7. An engine starter device for starting an internal combustion engine having a ring gear, said starter device comprising:

a power shaft having one end;

a pinion gear slidably mounted on said power shaft for axial movement relative to said power shaft, said pinion gear further moving into and out of engagement with said ring gear to start said engine;

an intermediate sleeve member non-rotatably mounted to said power shaft;

an outer sleeve member axially movably mounted on said intermediate sleeve member;

a driving sleeve member non-rotatably mounted on said intermediate sleeve member;

an enclosing cup member mounted adjacent to said pinion gear, said enclosing cup member having a closed end connected to said pinion gear for rotation therewith and an open end opposite said closed end defining a cavity betwen said open end and said closed end;

clutch means, mounted on said outer sleeve member and connected to said power shaft for movement relative thereto;

means for axially moving said pinion gear into mesh with said ring gear in response to the rotation of said power shaft, said means for axially moving transmitting torque from said outer sleeve member to said ring gear and disengaging said pinion gear from said ring gear when said pinion gear rotates above a predetermined speed; and an annular resilient member disposed within said cavity of said enclosing cup member, said annular resilient member further transmitting torque from said outer sleeve member to said pinion gear.

8. An engine starter device as claimed in claim 7 further comprising:

means for indexing said pinion gear when said pinion gear abuts said ring gear such that said means for indexing rotates said pinion gear to clear the abutment of said ring gear and said pinion gear engages said ring gear.

9. An engine starter device as claimed in claim 8 further comprising:

anti-drift means, mounted on said outer sleeve member for preventing axial movement of said pinion gear towards said ring gear after said internal combustion engine is started.

10. An engine starter device as claimed in claim 9 further comprising:

resilient means, interposed said intermediate sleeve member and said outer sleeve member for urging said outer sleeve member away from said pinion gear.

11. An engine starter device for engaging a ring gear of an internal combustion engine, said starter device comprising:

a power shaft having one end, a first outer diameter adjacent said one end and a second outer diameter adjacent said first outer diameter, said second outer diameter being larger than said first outer diameter;

a pinion gear slidably mounted on said first outer diameter of said power shaft for axial movement relative to said power shaft, said pinion gear further moving into and out of engagement with said ring gear of the engine to be started;

an intermediate sleeve member fastened to said second outer diameter of said power shaft for rotation therewith;

an outer sleeve member slidably mounted on said intermediate sleeve member, said outer sleeve member having external helical splines;

means mounted on said outer sleeve member and connected to said power shaft, for transmitting torque between said power shaft and said outer sleeve member in one direction of relative rotation;

at least one control nut member threadably mounted on said external helical splines on said outer sleeve member;

an enclosing cup member mounted adjacent to said pinion gear, said enclosing cup member having a closed end connected to said pinion gear, an open end opposite to said closed end and a cavity therebetween;

resilient cushion means, disposed in said cavity of said enclosing cup member between said at least one control nut member and said closed end of said enclosing cup member, for transmitting torque from said at least one control nut member to said pinion gear;

a stop member fixedly mounted on said first outer diameter of said power shaft to limit the axial movement of said pinion gear relative to said power shaft;

means for indexing said pinion gear when said pinion gear abuts said ring gear of the engine to be started such that said indexing means rotates said pinion gear to clear an abutment with said ring gear to permit engagement of said pinion gear with said ring gear of said internal combustion engine;

means for traversing said pinion gear into mesh with said ring gear of the engine to be started, said traversing means being responsive to the rotation of said power shaft and disengaging said pinion gear from said ring gear of the engine to be started when said pinion gear rotates above a predetermined speed;

means for transmitting torque from said power shaft to said pinion gear to rotate said ring gear; and means mounted adjacent said open end of said enclosing cup member, for retaining said at least one control nut member within said cavity of said enclosing cup member and permitting axial movement relative thereto.

12. An engine starter device for starting an internal combustion engine having a ring gear, said internal combustion engine having starter means, said starter means having a power shaft, said power shaft having one end, a first outer diameter adjacent said one end and a second outer diameter adjacent said first outer diameter, said second outer diameter being larger than said first outer diameter, said starter device comprising:

a pinion gear slidably mounted on said first outer diameter of said power shaft for axial movement relative to said power shaft, said pinion gear further adapted for movement with said ring gear of the engine to be started;

a stop member mounted on said first outer diameter adjacent said one end to limit the axial movement of said pinion gear on said power shaft;

drive means, responsive to the rotation of said power shaft, for moving said pinion gear into mesh with said ring gear so as to crank said internal combustion engine, said drive means further preventing demeshing of said pinion gear from said ring gear of the engine to be started below a predetermined rotational speed of said pinion gear, said drive means further comprising:

at least one control nut member;

an enclosure cup member connecting said at least one control nut member to said pinion gear, said enclosure cup member having a closed end, an open end, and a portion defining a cavity between said open end and said closed end; and resilient cushion means, interposed said at least one control nut member and said closed end of said enclosure cup member, for transmitting torque from said at least one control nut member to said pinion gear.

* * * * *

UNITED STATES PATENT AND TRADEMARK OFFICE

CERTIFICATE OF CORRECTION

PATENT NO. : 4,524,629

DATED : June 25, 1985

INVENTOR(S) : James John Digby

It is certified that error appears in the above-identified patent and that said Letters Patent is hereby corrected as shown below:

Column 4, line 56, delete "tool" and insert ---- tooth ----.

Column 6, line 11, delete "the" and insert ---- a ----.

Column 6, line 12, after "of" insert ---- the ----.

Column 7, line 48, after "in" insert ---- the ----.

Signed and Sealed this

*Twenty-ninth* Day of *October 1985*

[SEAL]

*Attest:*

*Attesting Officer*

DONALD J. QUIGG

*Commissioner of Patents and Trademarks—Designate*